US008672567B2

(12) United States Patent
Tsugaru et al.

(10) Patent No.: US 8,672,567 B2
(45) Date of Patent: Mar. 18, 2014

(54) PRINTER APPARATUS

(75) Inventors: Hiroyuki Tsugaru, Saitama (JP); Katsutoshi Mukaijima, Tokyo (JP); Tetsuya Yamamoto, Tokyo (JP); Gen Matsushima, Tokyo (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 266 days.

(21) Appl. No.: 12/972,863

(22) Filed: Dec. 20, 2010

(65) Prior Publication Data

US 2011/0164913 A1 Jul. 7, 2011

(30) Foreign Application Priority Data

Jan. 5, 2010 (JP) ..... 2010-000405

(51) Int. Cl.
*B65H 26/00* (2006.01)

(52) U.S. Cl.
USPC ..... 400/583; 400/611; 242/348; 242/563.2

(58) Field of Classification Search
USPC ..... 400/583
See application file for complete search history.

(56) References Cited

U.S. PATENT DOCUMENTS

| | | | | |
|---|---|---|---|---|
| 4,204,180 | A * | 5/1980 | Usui et al. | 242/563.2 |
| 5,820,068 | A * | 10/1998 | Hosomi et al. | 242/563 |
| 6,502,784 | B1 | 1/2003 | Sato | |
| 6,629,666 | B2 * | 10/2003 | Lee et al. | 242/563 |
| 7,011,463 | B2 * | 3/2006 | Matsuse | 400/594 |
| 7,018,119 | B2 * | 3/2006 | Koyabu | 400/242 |
| 7,507,045 | B1 * | 3/2009 | Harris et al. | 400/613 |
| 7,553,097 | B2 * | 6/2009 | Salussolia et al. | 242/563 |
| 7,553,098 | B2 * | 6/2009 | Maekawa et al. | 400/613 |
| 8,240,928 | B2 * | 8/2012 | Tsugaru et al. | 400/583 |
| 2010/0247215 | A1 * | 9/2010 | Tsugaru et al. | 400/578 |

FOREIGN PATENT DOCUMENTS

| | | |
|---|---|---|
| JP | 2001-002296 | 1/2001 |
| JP | 2001-213553 | 8/2001 |

* cited by examiner

*Primary Examiner* — Jill Culler
(74) *Attorney, Agent, or Firm* — Myers Wolin, LLC

(57) ABSTRACT

A printing apparatus 100 includes a detecting unit, which detects that a core part at a center portion of a recording medium 202, in a rolled state, has reached a predetermined position accompanying the consumption of the recording medium 202 in a recording medium accommodating unit 301 accommodating the recording medium 202, when the printer apparatus 100 is in an installed state; and further includes a moving mechanism that moves the detecting unit to a position whereby the detecting function of the detecting unit is deactivated.

12 Claims, 13 Drawing Sheets

PRINTER APPARATUS

CROSS REFERENCE TO RELATED APPLICATIONS

This application is based upon and claims the benefit of priority of the prior Japanese Patent Application No. 2010-000405, filed on Jan. 5, 2010, now pending, the entire contents of which are herein wholly incorporated by reference.

BACKGROUND OF THE INVENTION

1. Field of the Invention

The present invention relates to a printer apparatus that holds a recording medium wound in a roll and that prints on the recording medium and particularly, to a printer apparatus that has a near-end detecting unit detecting that the amount of recording medium that remains is a given amount or less.

2. Description of the Related Art

Among printers that print on a recording medium wound in a roll are those facilitating simplification of recording medium replacement by employing a configuration that does not axially support a core part of the recording medium but rather supports the recording medium from below.

Meanwhile, as a so-called near-end detecting mechanism detecting that the amount of recording medium that remains is a given amount or less, a conventional printer, such as that recited in Japanese Patent Application Laid-Open Publication No. 2001-213553, has a rolled paper loading mechanism that includes, for example, a rolled paper loading unit loaded with a roll of recording paper having a core, a near-end detecting unit detecting that the amount remaining of the roll of recording paper loaded in the loading unit is a given amount or less, a front opening of the rolled paper loading unit, and a rolled paper cover covering the front opening in a state enabling the opening and closing of the front opening. When the roll of recording paper becomes smaller and the near-end detecting unit lowers the position of the core, in the rolled paper loading mechanism having a detection lever that is inserted in the core, a height adjusting unit adjusts the attached height of the detecting lever with respect to the rolled paper loading unit and an indicator unit indicates the relative heights of the detecting lever and the rolled paper loading unit. The indicating unit has a mark formed at the rolled paper loading unit and a mark formed at the detecting lever. These marks are formed at a position that is visible from the front opening.

Further as a near-end sensing mechanism, for example, in a rolled paper remaining amount detecting unit for detecting the remaining amount of rolled paper housed in a paper housing unit, a paper-remaining-amount detector/adjusting member is provided in a movable manner with respect to the paper housing unit and includes a paper detecting unit that detects whether there is rolled paper and a nail unit for positioning the paper detecting unit at multiple positions; and a notch that is formed in the paper housing unit and engages with the nail unit to set the position of the paper-remaining-amount detector/adjusting member. (See, for example, Japanese Patent Application Laid-Open Publication No. 2001-2296)

Here, without using the function of near end detection, some users of the printer may determine the amount remaining of a recording medium wound in a roll by viewing a marking provided at an end portion (the starting portion of the winding) of the recording medium. In this case, the detection and notification of the near end executed by the printer are rather troublesome and therefore, the near end detecting function may be deactivated.

As described, for the conventional technologies recited in Japanese Patent Application Laid-Open Publication No. 2001-213553 or in Japanese Patent Application Laid-Open Publication No. 2001-2296, in order to deactivate the near-end detecting function at a circuit level, for example, a dip switch disposed on a circuit board must be operated to deactivate the near-end detecting function, or to deactivate the near-end detecting function through software control, keys on an operation panel have to be manipulated to change software settings. Nonetheless, in order to operate the dip switch, a cover enabling access to the circuit board disposed in the printer must first be opened. Furthermore, in order to operate the keys on the operation panel to change the software settings, the user must refer to the instruction manual while searching through various menu layers for the items to be set, making inactivation of the near-end detecting function troublesome.

As a countermeasure, although it is conceivable to dispose a dedicated operation key for activating and deactivating the near-end detecting function, a problem arises in that the disposal of a dedicated operation key increases cost.

To solve the problems associated with conventional technologies above, an object of the present invention is to provide a highly versatile printer apparatus enabling easy deactivation of a near-end detecting function by a simple mechanism.

SUMMARY OF THE INVENTION

To solve the problems above and achieve an object, a printer apparatus according to the present invention supplies a recording medium that is in a rolled state, from a recording medium accommodating unit accommodating the recording medium to a printing unit, to execute printing. The printer apparatus includes a recording medium holding unit that holds the recording medium and is formed in the recording medium accommodating unit; a detecting unit that detects that a core part in a center portion of the recording medium has reached a predetermined position accompanying consumption of the recording medium held in the recording medium holding unit; and a moving mechanism that moves the detecting unit to a position that deactivates the detecting unit.

DETAILED DESCRIPTION OF THE PREFERRED EMBODIMENTS

Referring to the accompanying drawings, exemplary embodiments according to the present invention are explained in detail below.

(First Embodiment)

Figure 1:
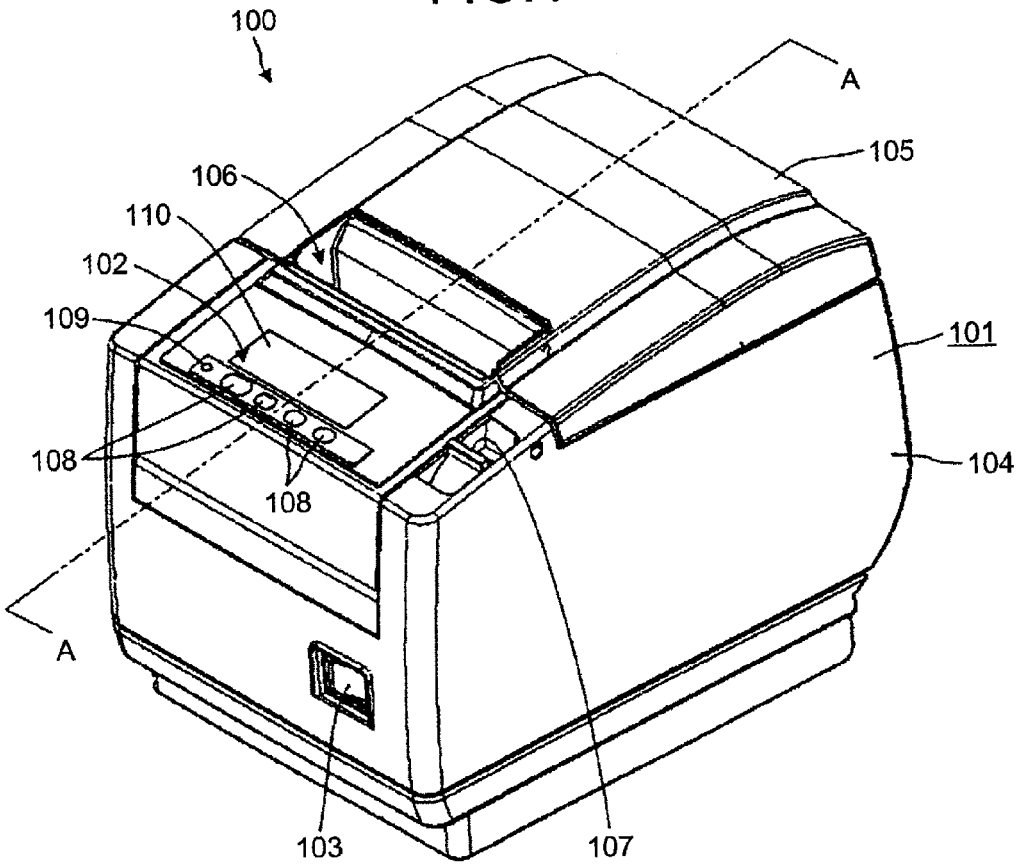
FIG. 1 is a first diagram for explaining a printer apparatus according to a first embodiment of the present invention.
Figure 2:
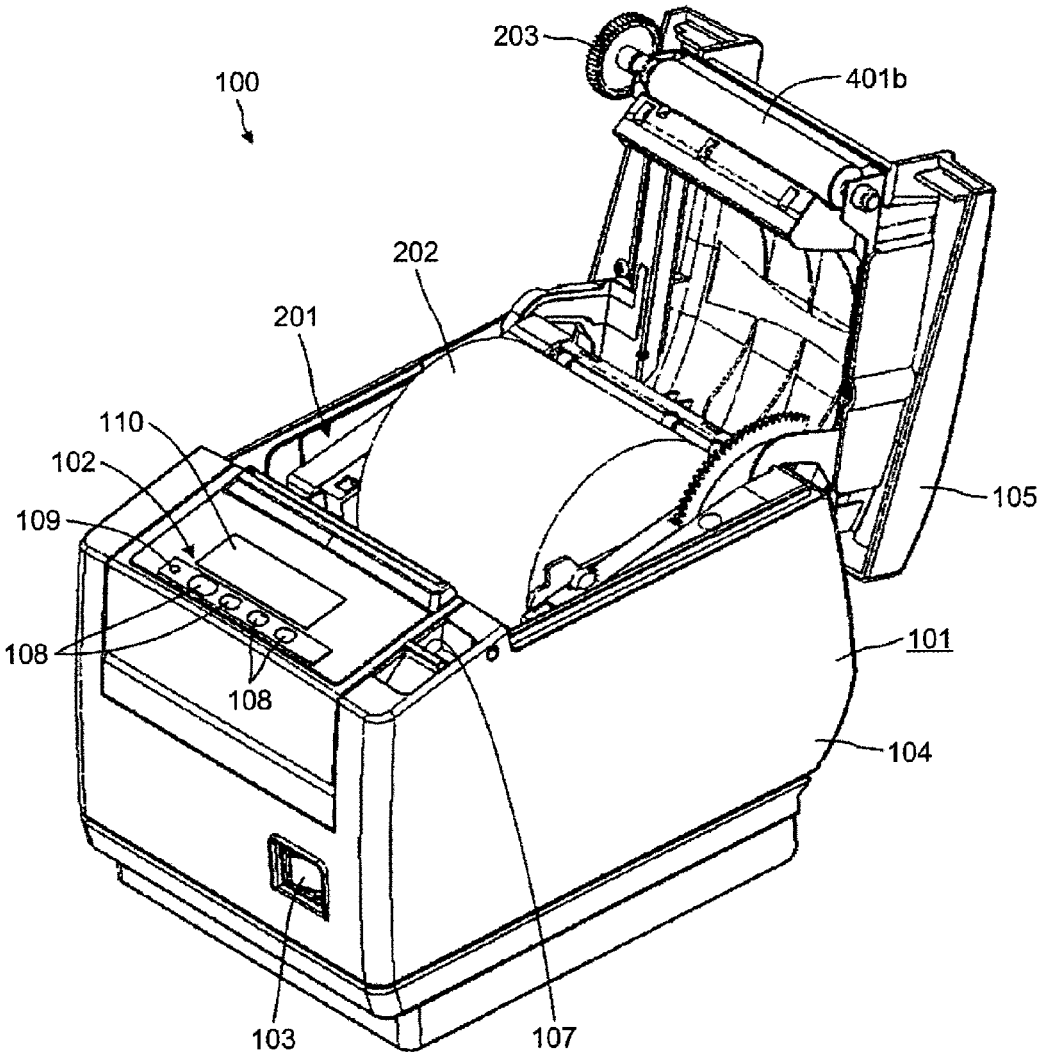
FIG. 2 is a second diagram for explaining the printer apparatus according to the first embodiment of the present invention.
Figure 3:
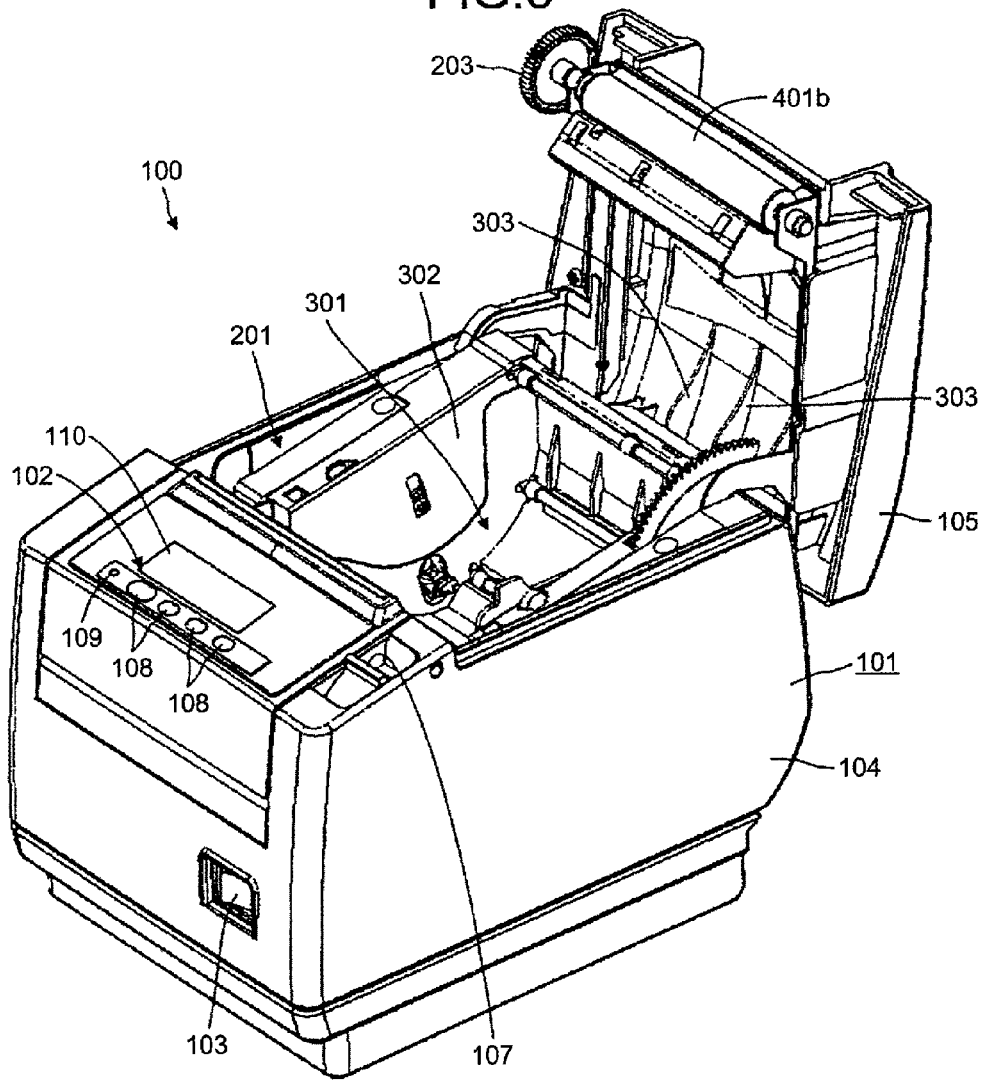
FIG. 3 is a third diagram for explaining the printer apparatus according to the first embodiment of the present invention.
Figure 4:
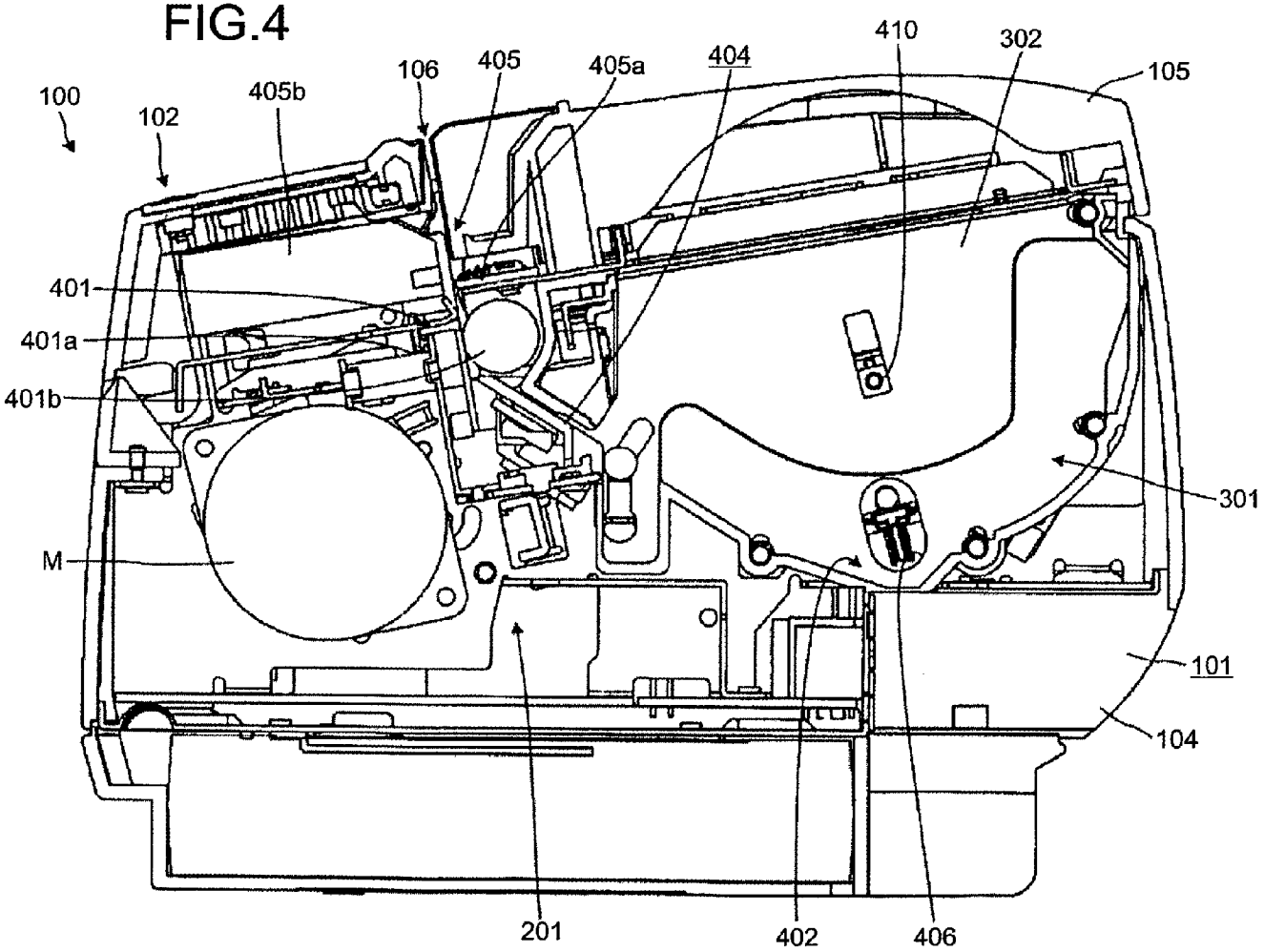
FIG. 4 is a fourth diagram for explaining the printer apparatus according to the first embodiment of the present invention.

A printer apparatus according to a first embodiment of the present invention will be described. FIGS. 1 to 4 are diagrams for explaining the printer apparatus according to the first embodiment of the present invention. FIGS. 1 to 3 depict external views of the printer apparatus according to the first embodiment of the present invention. FIG. 4 depicts a cross section (along an A-A line in FIG. 1) of the printer apparatus according to the first embodiment of the present invention.

As depicted in FIGS. 1 to 4, the printer apparatus 100 according to the first embodiment of the present invention includes a casing 101 that has a substantially box shape. A printer 201 is provided inside the casing 101 and includes a printing unit 401 having a print head 401*a* and a platen 401*b*, and a motor M (not depicted).

An operation panel 102 is provided at one aspect of the casing 101. The operation panel 102 is equipped with operation keys 108 for receiving various instructions for the printer apparatus 100, an LED lamp 109 that indicates the state of the printer apparatus 100, and a liquid crystal display unit 110 that, using characters or symbols, indicates the state of the printer apparatus 100. A power switch 103 that switches the power of the printer apparatus 100 ON and OFF is provided at another aspect of the casing 101.

When the power of the printer apparatus 100 is turned on and the printer apparatus 100 is in a printing stand-by state, when an error occurs in the printer apparatus 100, when the remaining amount of a recording medium 202 in the printer apparatus 100 is a given amount or less, etc., the LED lamp 109 is lit or is caused to blink and information is displayed on the liquid crystal display unit 110, thereby giving notification of the above situations.

The printing apparatus 100 includes a sound output apparatus that outputs predetermined sounds. The sound output apparatus outputs spoken instructions or a warning sound when an error occurs in the printer apparatus 100, when the remaining amount of the recording medium 202 in the printer apparatus 100 is a given amount or less, etc.

More specifically, the sound output apparatus may be implemented by, for example, a speaker. Alternatively, the sound output apparatus may be implemented by, for example, a buzzer. The sound output apparatus may be implemented easily using various known techniques and therefore, will not be described. The recording medium 202 has a long strip-shape and is wound from an end thereof along a longitudinal direction about a core into a roll.

The casing 101 includes a casing main body 104 that supports the printer 201, and a printer cover 105 that is coupled to the casing main body 104. The printer cover 105 is coupled to the casing main body 104 such that the interior of the casing main body 104 is enclosed and accessible via the printer cover 105.

A locking mechanism, not depicted, is provided between the casing main body 104 and the printer cover 105. When the printer cover 105 is positioned such that the interior of the casing main body 104 becomes enclosed, the locking mechanism is engaged and fixes the position of the printer cover 105 with respect to the casing main body 104.

In the casing 101, a recording medium discharge opening 106 is formed by a gap formed between the casing main body 104 and the printer cover 105 when the interior of the casing main body 104 is enclosed by the printer cover 105. The recording medium discharge opening 106 communicatively connects the interior of the casing 101 to the outside thereof, and discharges therethrough the recording medium 202 on which printing is executed by a printing unit 401 included in the printer 201 housed in the casing 101, to the outside of the casing 101. The recording medium 202 is wound in a roll and accommodated in a recording medium accommodating unit 301 included in the printer apparatus 100. The recording medium accommodating unit 301 supports an outer circumferential portion of the recording medium 202 wound in a roll.

On one aspect of the casing 101, a lock release lever 107 is provided that disengages the engagement of the locking mechanism when the lock release lever 107 is manipulated by a user, etc., of the printer apparatus 100. When the lock release lever 107 is manipulated and the engagement of the locking mechanism is disengaged, the printer cover 105 moves in a direction widening the recording medium discharge opening 106 with respect to the casing main body 104 and thereby, opens the recording medium accommodating unit 301.

In a state where the printer cover 105 is moved in an opening direction and the recording medium accommodating unit 301 is opened to the exterior, the recording medium 202 wound in a roll may be put in the recording medium accommodating unit 301, the recording medium 202 accommodated in the recording medium accommodating unit 301 may be removed from the recording medium accommodating unit 301, etc. The lock release lever 107 is manipulated when, for example, the remaining amount of the recording medium 202 accommodated in the recording medium accommodating unit 301 is an insufficient amount and a new recording medium 202 is to be set.

The recording medium accommodating unit 301 includes a box-shaped member 302 and accommodating unit ribs 303. The box-shaped member 302 is supported by the casing 101, has a bottom portion curved in a substantially semicircular shape and a side wall portion, and has a shape of which one aspect facing toward the bottom portion is open. The accommodating unit ribs 303 are provided on the printer cover 105 and protrude toward the box-shaped member 302. The box-shaped member 302 and the accommodating unit ribs 303 form the recording medium accommodating unit 301 whose cross section is substantially circular when the printer cover 105 is fixed to the casing main body 104.

The box-shaped member 302 includes a recording medium holding unit 402. The recording medium holding unit 402 is curved at a curvature that is equal to or larger than that of the maximal outer diameter of the recording medium 202 wound in a roll to be accommodated in the recording medium accommodating unit 301, and is a member that has a curved shape of which a lower end protrudes downward when the printer apparatus 100 is in an installed state. The recording medium holding unit 402 may be implemented by a portion of the bottom portion of the recording medium accommodating unit 301.

Thus, when the printer apparatus 100 is in an installed state, the recording medium 202 wound in a roll is moved by its own weight as the recording medium 202 is consumed such that the recording medium 202 is received in the lower end of the curved aspect formed by the recording medium holding unit 402. In the first embodiment, the recording medium holding unit 402 frontally faces the printer cover 105 and is a curved aspect that is curved such that a portion thereof that is more central becomes more distant from the printer cover 105. The recording medium holding unit 402 may be implemented by a portion of the bottom portion of the box-shaped member 302.

When the printer cover 105 is fixed to the casing main body 104, a recording medium conveyance path 404 is formed in the casing 101. The recording medium conveyance path 404 communicatively connects the recording medium accommodating unit 301 and the recording medium discharge opening 106. The recording medium conveyance path 404 communicatively connects the recording medium accommodating unit 301 and the recording medium discharge opening 106 through the printing unit 401.

The printing unit 401 prints characters, etc., on the recording medium 202 conveyed from the recording medium accommodating unit 301 to the recording medium discharge opening 106. The printing unit 401 is not limited to one that prints characters, and may print items other than characters such as symbols, given logo marks, and other images. In the first embodiment, the printing unit 401 prints under a thermal printing scheme. Nonetheless, the printing scheme is not limited to a thermal printing scheme and may be any among various schemes such as an impact dot scheme and an ink jet scheme.

The printing unit 401 includes a printing head 401*a* and a platen 401*b*. The printing head 401*a* and the platen 401*b* are disposed facing each other sandwiching the recording medium conveyance path 404 therebetween. For example, the printing unit 401 that prints under a thermal printing scheme may include a thermal-printing-scheme printing head (thermal head) 401*a* and the platen 401*b*.

For example, the thermal-printing-scheme printing head (thermal head) 401*a* includes multiple heating elements arranged in a line along the width of the recording medium 202, selectively energizes the heating elements to selectively cause the heating elements to heat and thereby, prints characters, etc. The printer 201 including the printing unit 401 that prints under a thermal printing scheme as described above uses the recording medium 202 that has a thermal color developing property. The thermal-printing-scheme printing head 401*a* and a control method of the printing head 401*a* may be implemented easily using various known techniques and therefore, will not be described.

The platen 401*b* has a substantially columnar shape having an axial center direction crossing the direction of the conveyance of the recording medium 202 (a direction penetrating the paper hereof FIG. 4). An end of a shaft of the platen 401*b* is fitted with a gear 203. The gear 203 is rotated by a driving force transmitted to the gear 203 from a motor M that is provided in the casing main body 104. The platen 401*b* rotates with the rotation of the gear 203. The motor M and the gear 203 are engaged through a series of gears not depicted.

The platen 401*b* faces the printing head 401*a* sandwiching therebetween the recording medium 202 that is conveyed in the recording medium conveyance path 404, and during printing, supports the recording medium 202 from a back surface against a printing force induced by the printing head 401*a*. The platen 401*b* conveys the printed recording medium 202 from the recording medium accommodating unit 301 to the recording medium discharge opening 106 by rotating about the axial center.

In the recording medium conveyance path 404, a cutting mechanism 405 is provided at a position that is closer to the recording medium discharge opening 106 than the printing unit 401. The cutting mechanism 405 includes a fixed blade 405*a* whose position is fixed and a moveable blade (not depicted) provided at a position such that the moveable blade faces the fixed blade 405*a* sandwiching the recording medium conveyance path 404 therebetween. The fixed blade 405*a* is provided on the printer cover 105. The moveable blade is provided movably in directions causing the moveable blade to come into contact with and move away from the fixed blade 405*a*. The moveable blade is provided in the casing main body 104.

In the first embodiment, the moveable blade is provided in a moveable blade unit 405*b* that is configured by integrating the moveable blade and mechanisms to move the moveable blade into one unit. The moveable blade unit 405*b* is detachably provided in the casing main body 104. When the moveable blade is worn or when any of the mechanisms to move the moveable blade become aged, the moveable blade unit 405*b* may be replaced.

When the recording medium 202 is positioned between the fixed blade 405*a* and the moveable blade, the cutting mechanism 405 cuts the recording medium 202 positioned between the fixed blade 405*a* and the moveable blade by causing the moveable blade to come into contact with the fixed blade 405*a*. Thereby, the cutting mechanism 405 cuts, at an arbitrary length, the recording medium 202 on which printing has been executed by the printing unit 401.

After cutting the recording medium 202, the cutting mechanism 405 moves the moveable blade in a direction causing the moveable blade to move away from the fixed blade 405*a* to form a gap between the fixed blade 405*a* and the moveable blade. By rotating the platen 401*b* in this state, the recording medium 202 accommodated in the recording medium accommodating unit 301 is sent out being unrolled toward the recording medium discharge opening 106. Thereby, the recording medium 202 can be subjected to the next printing.

The recording medium 202 wound in a roll and accommodated in the recording medium accommodating unit 301 is pulled out starting from an outer circumference and is fed to the printing unit 401 by the rotation of the platen 401*b* to send out the recording medium 202, unrolling toward the recording medium discharge opening 106. The recording medium 202 wound in a roll is rotated in the recording medium accommodating unit 301 by being pulled out starting from the outer circumference. In the recording medium accommodating unit 301, the recording medium 202 wound in a roll is rotated about the shaft around which the recording medium 202 is wound into a roll.

Therefore, in a state where the recording medium 202 wound in a roll can be rotated about the shaft of the recording medium 202, the recording medium accommodating unit 301 accommodates and holds the recording medium 202 wound in a roll. When the recording medium 202 wound in a roll is accommodated in the recording medium accommodating unit 301, the recording medium 202 is supported from below in the vertical direction by the recording medium holding unit 402.

The printer apparatus 100 includes a remaining amount detecting mechanism that detects (senses) the remaining amount of the recording medium 202 wound in a roll and accommodated in the recording medium accommodating unit 301. The remaining amount detecting mechanism includes a detecting unit that detects the remaining amount of the recording medium 202 wound in a roll and held in the recording medium holding unit 402.

The printer apparatus 100 includes a switching lever 410 operated to change the state of the remaining amount detecting mechanism to be activated or deactivated.

The user of the printer apparatus 100, by operating the switching lever 410 is able to change the state of the remaining amount detecting mechanism to activate or deactivate the detecting function of the detecting unit. The remaining amount detecting mechanism and the switching mechanism are described hereinafter (with reference to FIGS. 5 to 9).

The remaining amount detecting mechanism is disposed inside the casing main body 104 and outside the recording medium accommodating unit 301. Via a window provided in the side wall portion of the box-shaped member 302, the detecting unit of the remaining amount detecting mechanism detects the remaining amount of the recording medium 202 wound in a roll and held in the recording medium holding unit 402.

(Configuration of Remaining Amount Detecting Mechanism)

Figure 5:
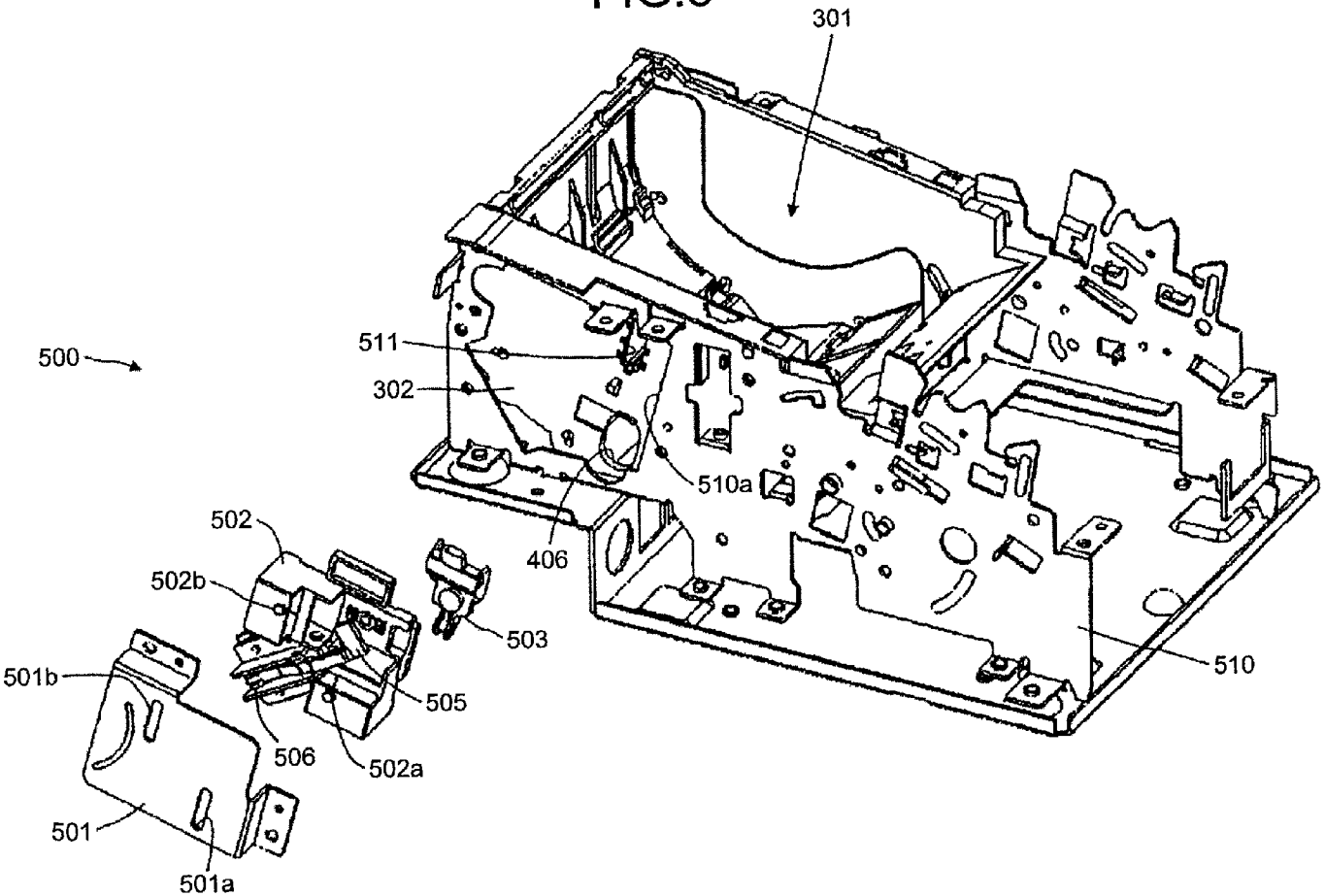
FIG. 5 is a first diagram for explaining a remaining amount detecting mechanism.
Figure 6:
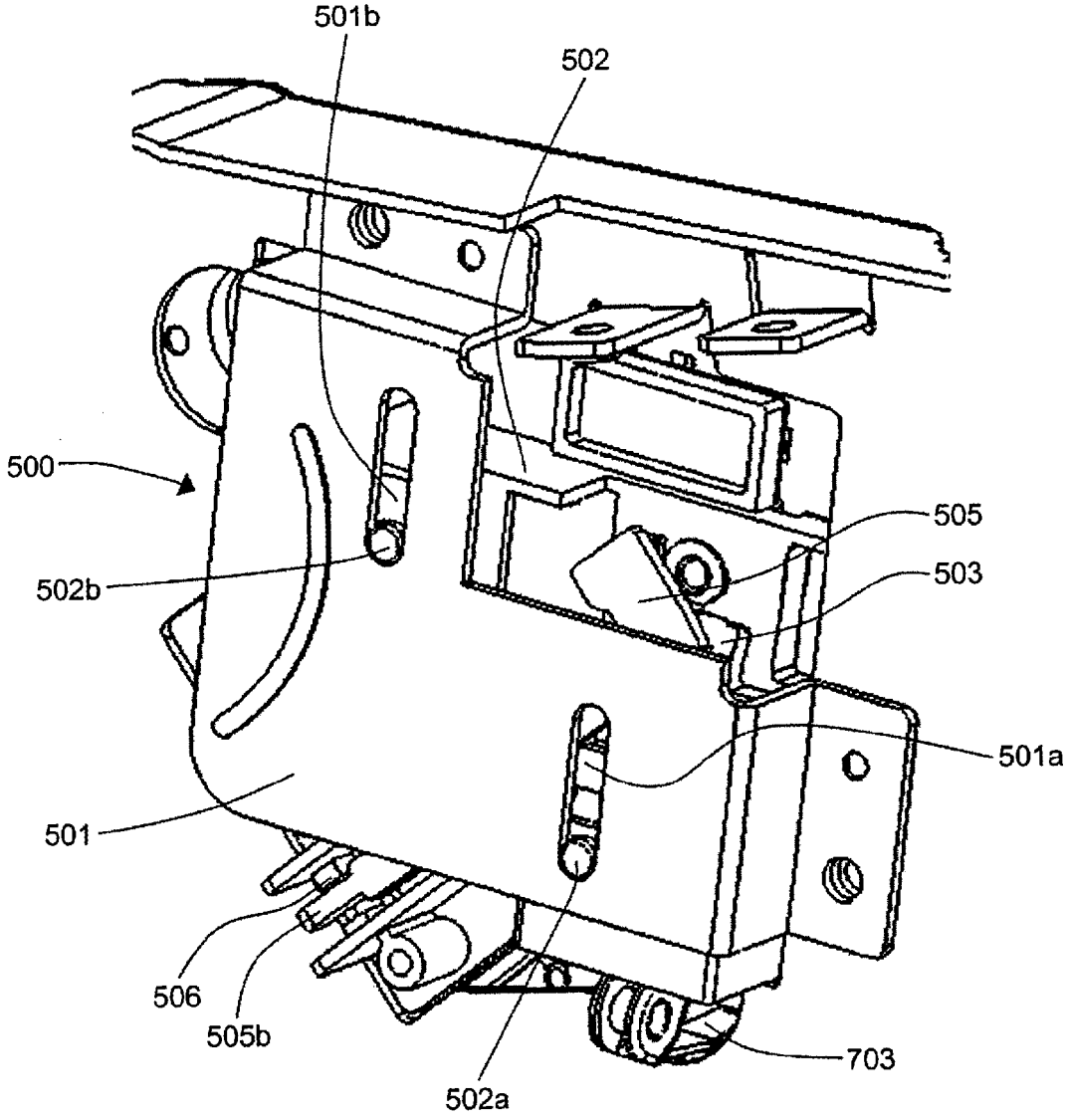
FIG. 6 is a second diagram for explaining the remaining amount detecting mechanism.
Figure 7:
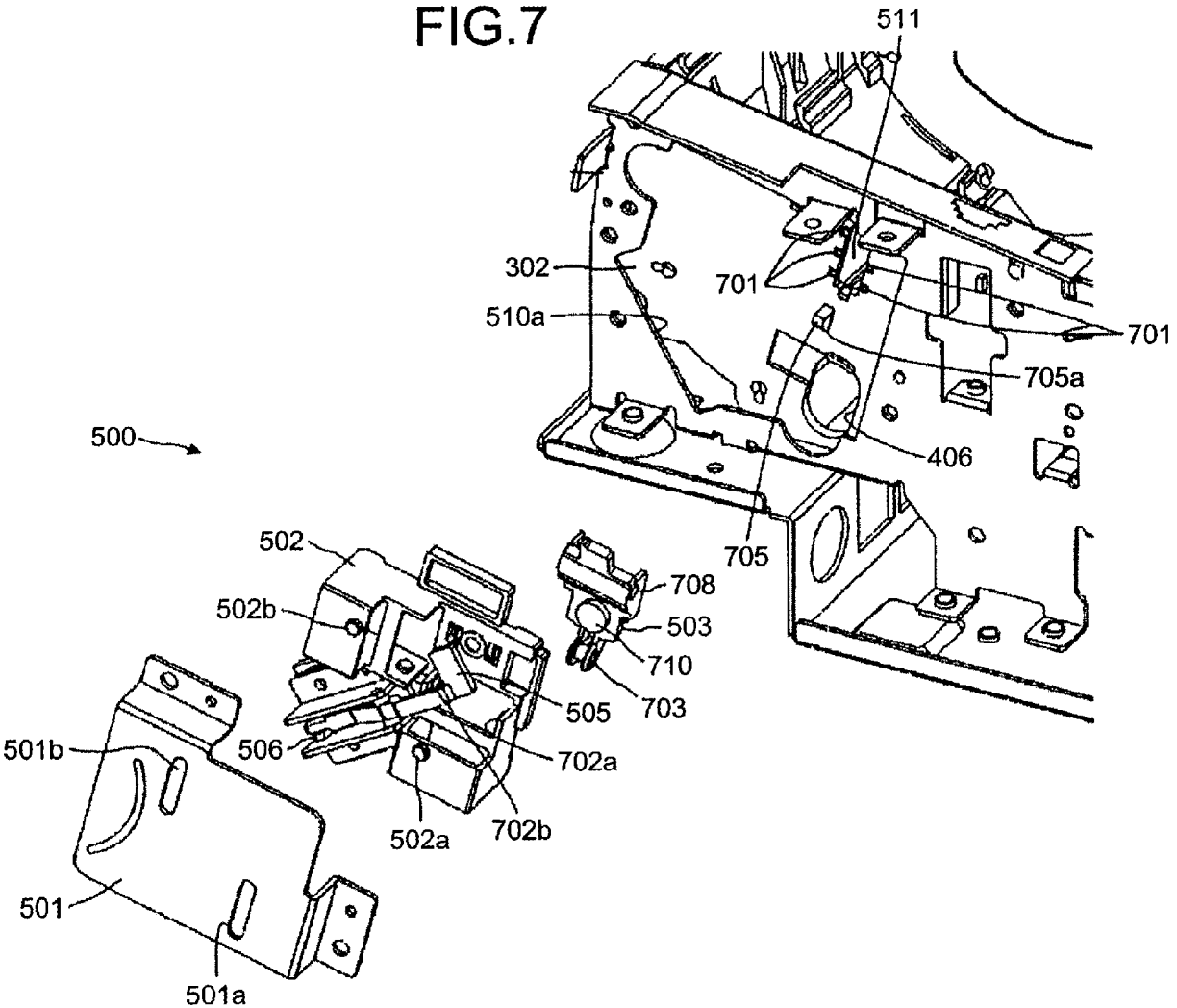
FIG. 7 is a third diagram for explaining the remaining amount detecting mechanism.
Figure 8:
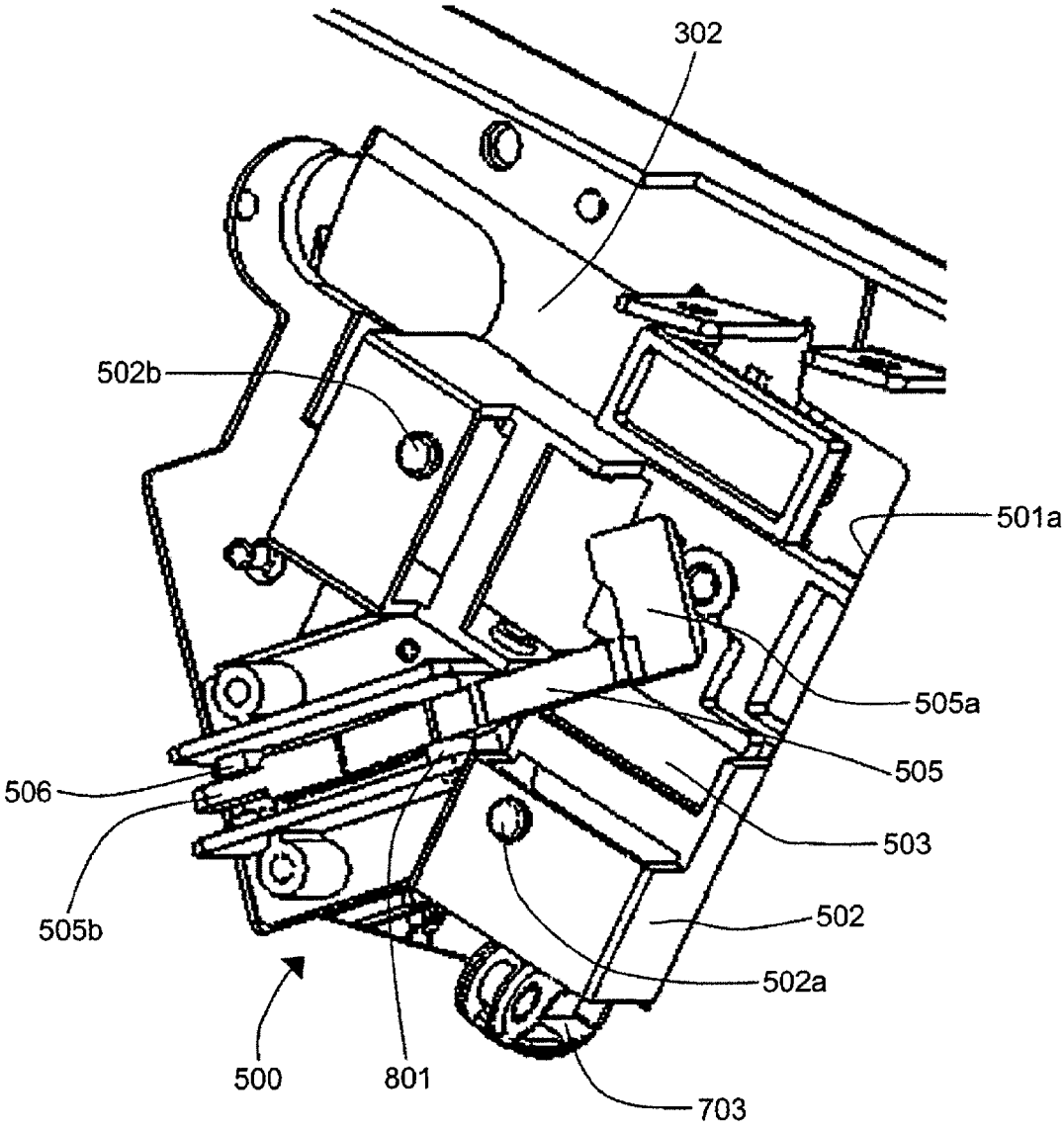
FIG. 8 is a fourth diagram for explaining the remaining amount detecting mechanism.
Figure 9:
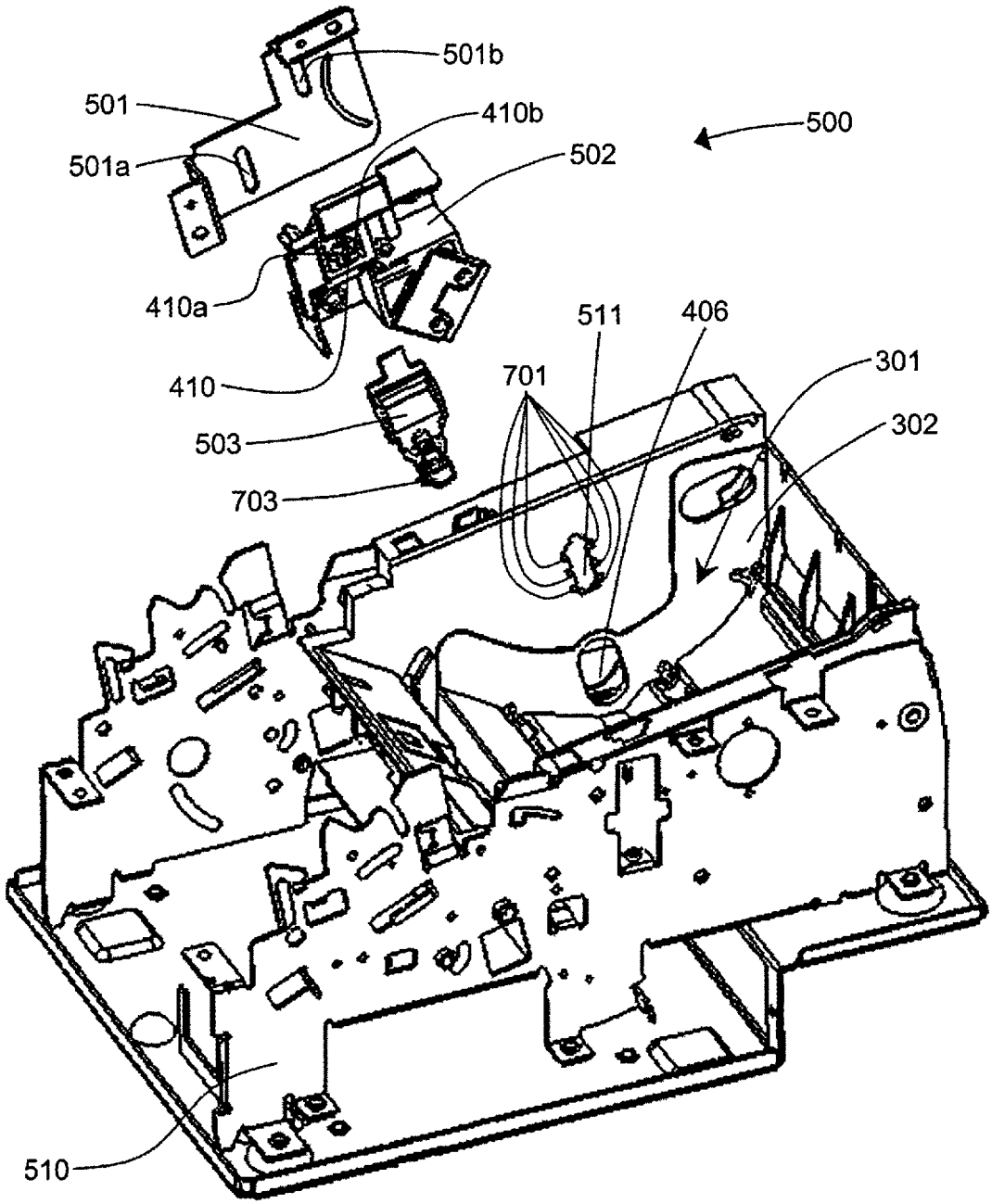
FIG. 9 is a fifth diagram for explaining the remaining amount detecting mechanism.

The configuration of the remaining amount detecting unit will be described. FIGS. 5 to 9 are diagrams for explaining the remaining amount detecting mechanism. FIG. 5 depicts the remaining amount detecting mechanism in a disassembled state and the position of the remaining amount detecting mechanism in the printer apparatus 100. FIG. 6 depicts the remaining amount detecting mechanism attached to the printer apparatus 100. FIG. 7 is an exploded view of a portion of the remaining amount detecting mechanism depicted in FIG. 5. FIG. 8 depicts a portion of the remaining amount detecting mechanism attached to the printer apparatus 100. FIG. 9 is an exploded view of the remaining amount detecting mechanism from a side opposite to that depicted in FIG. 5.

In FIGS. 5 to 9, a remaining amount detecting mechanism 500 is disposed in the printer apparatus 100, in a space between the box-shaped member 302 and the casing 101. The remaining amount detecting mechanism 500 includes a unit cover member 501, a unit frame member 502, a detecting lever 503, an interlocked detecting lever 505, and a detection sensor 506.

In the present embodiment, a detecting lever can be implemented by the detecting lever 503. Further, in the embodiment, a detecting switch can be implemented by the detection sensor 506 and the interlocking lever 505. The unit cover member 501, through an opening 510*a* disposed in a main bode frame of the printer apparatus 100, is disposed in the box-shaped member 302 forming the recording medium accommodating unit 301.

A pair of openings 708 are disposed in the detecting lever 503, which is interlocked with the unit frame member 502 by fitting the openings 708 to a pair of protrusions 702*a* and 702*b* disposed opposing the unit frame member 502. The detecting lever 503 is disposed to be swingable with respect to the unit frame member 502 about the protrusions 702*a* and 702*b* as pivots.

The detecting lever 503 is provided such that, in a case where the printer apparatus 100 is in an installed state, when the shaft of the recording medium 202 wound in a roll moves as the recording medium 202 is consumed, the detecting lever 503 swings parallel to the direction of the movement.

An end of the detecting lever 503 has a protrusion 703 that protrudes toward the window 406, i.e., the recording medium accommodating unit 301. A compression coil spring, not depicted, is provided between a cylinder-like protrusion 710 provided on the detecting lever 503 and the unit frame member 502. The detecting lever 503 is biased in a direction to protrude the protrusion 703 from the window 406 toward the inside of the recording medium accommodating unit 301 by the restoring force of the compression coil spring.

The interlocked detecting lever 505 is coupled to the unit frame member 502 by fitting a shaft portion 801 formed protruding from both sides about the center into a hole provided in the unit frame member 502, and is provided in the unit frame member 502 swingably about the shaft portion 801 as the fulcrum. The interlocked detecting lever 505 is provided such that an end 505*a* thereof faces an end opposite to the protrusion 703 of the detecting lever 503 and the other end 505*b* thereof faces the detection sensor 506.

The shaft portion 801 of the interlocked detecting lever 505 has a helical torsion coil spring, not depicted. The helical torsion coil spring biases the interlocked detecting lever 505 such that the end 505*a* of the interlocked detecting lever 505 abuts the end opposite to the protrusion 703 of the detecting lever 503 and keeps the other end 505*b* of the interlocked detecting lever 505 away from the detection sensor 506.

The biasing force of helical torsion coil spring with respect to the interlocked detecting lever 505 is set to be weaker than the biasing force of the compression coil spring. Consequently, the interlocked detecting lever 505 is biased toward the end opposite to the protrusion 703 of the detecting lever 503 and the other end 505*b* is able to swing approaching the detection sensor 506.

The detection sensor 506 can be implemented by a transmission type optoelectric sensor. The detection sensor 506 is capable of changing output according to the position of the interlocked detecting lever 505 with respect to the detection sensor 506. The detection sensor 506 can change output when the end 505*a* of the interlocked detecting lever 505 is biased toward the end opposite the protrusion 703 of the detection sensor 506 and the other end 505*b* is in proximity to the detection sensor 506, at a position covering the light emitting unit and the light receiving unit of the detection sensor 506; and when the detecting lever 503 resists the restoring force of the compression coil spring and is swingable, and the interlocked detecting lever 505, under the biasing force of the helical torsion coil spring, swings the other end 505*b* to a position away from the detection sensor 506.

The unit frame member 502 is disposed between the unit cover member 501 and the box-shaped member 302 and is capable of moving within a space formed by the unit cover member 501 and the box-shaped member 302. The switching lever 410 is disposed integrated with the unit frame member 502, engages with a slit 511 disposed in the box-shaped member 302, and through the slit 511, protrudes to the recording medium accommodating unit 301 side.

The switching lever 410 engages with the slit 511 in a state of being moveable along the slit 511. When the switching lever 410 is moved along the slit 511, the position of the unit frame member 502 changes with respect to the recording medium accommodating unit 301. The slit 511 is of a linear shape, whereby the unit frame member 502 moves along a linear path.

In the slit 511, between both ends (two locations), engaging recesses 701 are disposed. The switching lever 410 has engaging protrusions 410*a* and 410*b*. By an engagement of the engaging protrusions 410*a* and 410*b* with the engaging recesses 701, the position of the switching lever 410 in the slit 511 can be fixed. In the first embodiment, a guide unit for moving the detection unit to a position activating or deactivating the detecting function of the detection unit is implemented by the slit 511 the detection unit.

Through such a configuration, the position of the unit frame member 502 with respect to the recording medium accommodating unit 301 can be adjusted and the position can also be fixed.

In the first embodiment, the engaging recesses 701 are disposed at both ends (two locations) of the slit 511 and between the ends (three locations). Consequently, the position of the unit frame member 502 with respect to the recording medium accommodating unit 301 can be fixed at three locations.

Nonetheless, the positions of the engaging recesses 701 is not limited to the three positions above. The engaging recesses 701 may be disposed at more than three locations. By increasing the number of engaging recesses 701, the position of the unit frame member 502 with respect to the recording medium accommodating unit 301 can be finely adjusted.

The unit frame member 502 includes the protrusions 502*a* and 502*b* that engage with slits 501*a* and 501*b* provided in the unit cover member 501. The slits 501*a* and 501*b* are of a linear shape similar to the slit 511 to guide the protrusions 502*a* and 502*b* moving with the unit frame member 502 as a result of operation of the switching lever 410.

The protrusions 502*a* and 502*b* disposed on the unit frame member 502 and the slits 501*a* and 501*b* with which the protrusions 502*a* and 502*b* engage are disposed at positions different from the slit 511 and the switching lever 410, along the direction in which the unit cover 501 and the unit frame member 502 overlap.

In a state where on the side of the recording medium accommodating unit 301, the slit 511 and the switching lever 410 are engaged and on the opposite side of the recording medium accommodating unit 301, the slits 501*a* and 501*b* are engaged with the protrusions 502*a* and 502*b*, whereby the unit frame member 502 is sandwiched between the box-shaped member 302 and the unit cover member 501 and movement of the unit frame member 502 can be guided. Therefore, the unit frame member 502 can be moved stably and with precision.

In the first embodiment, the detecting unit includes the detecting lever 503; the compression coil spring and the interlocked detecting lever 505 that are interlocked to the swinging of the detecting lever 503; and the unit frame member 502, and the unit covering member 501, etc., that support these components.

The detecting lever 503 is provided such that when the detecting unit is activated, the protrusion 703 faces the window 406. The detecting lever 503 is provided such that the end opposite to the protrusion 703 faces the end 505*a* of the interlocked detecting lever 505 in a direction to stack the detecting lever 503 and the interlocked detecting lever 505.

When the detecting unit is activated, the protrusion 703 protrudes into the recording medium accommodating unit 301 through the window 406. When the detecting unit is activated and the remaining amount of the recording medium 202 accommodated in the recording medium accommodating unit 301 is of a sufficient amount, the protrusion 703 abuts a side surface of the recording medium 202 wound in a roll. When the protrusion 703 abuts the side surface of the recording medium 202 wound in a roll, the detecting lever 503 resists the restoring force of the compression coil spring and swings in a direction that the end opposite to the protrusion 703 moves to move away from the end 505*a* of the interlocked detecting lever 505.

A retracting rib 705 is disposed in the box-shaped member 302, at a position interfering with the protrusion 703 that moves accompanying the operation of the switching lever 410 so as to protrude on the detecting lever 503 side. The retracting rib 705 has a sloping aspect 705*a* whose upward incline is away from the window 406 such that the extent to which the protrusion 703 protrudes gradually increases with the incline away from the window 406.

Figure 12:
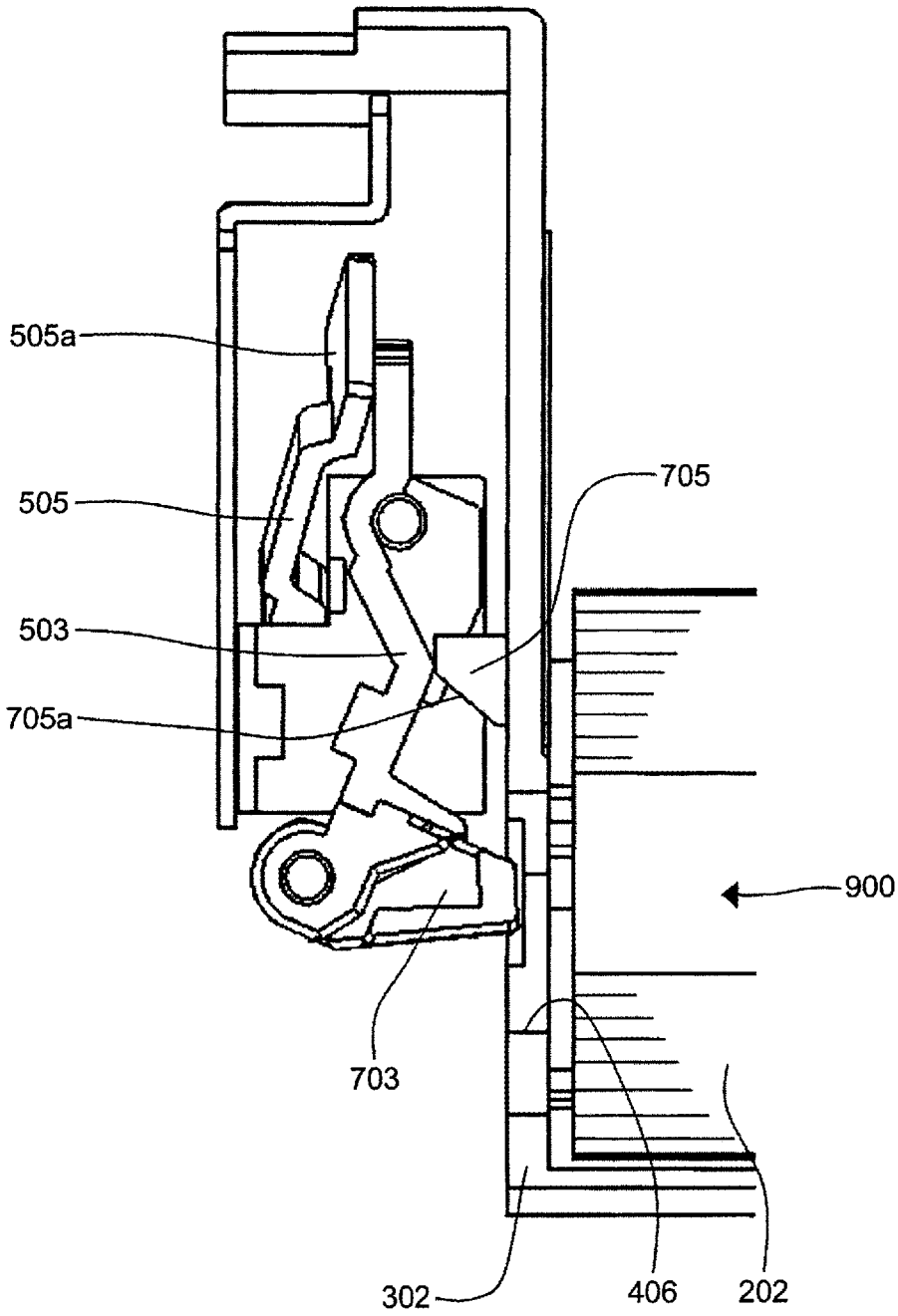
FIG. 12 is a diagram for explaining a detecting lever and vicinity thereof when a detecting unit is deactivated.

Thus, in a state where the protrusion 703 is protruding from the window 406, if the switching lever 410 is operated to move the protrusion 703 in a direction (upward direction in FIG. 4) approaching the retracting rib 705, the detecting lever 503 is pushed by the sloping aspect 705*a* and the protrusion 703 swings in a direction approaching the unit cover member 501 (refer to FIG. 12).

In this way, the position of the end of the detecting lever 503 opposite of the protrusion is moved away from the end 505*a* of the interlocked detecting lever 505 according to the position of the unit frame member 502 by the retracting rib 705, whereby errant swinging of the interlocked detecting lever 505 consequent to inadvertent swinging of the detecting lever 503 of the detecting unit at the position deactivating the detecting function, can be prevented.

In the remaining amount detecting mechanism 500, the switching lever 410 is provided in the unit frame member 502, and the detecting lever 503 is provided in the unit frame member 502. Therefore, when the unit frame member 502 is moved by operating the switching lever 410, the detecting lever 503 moves interlocked with the unit frame member 502.

Therefore, in a state where the switching lever 410 is fixed at the lower end of the slit 511, the detecting lever 503 is positioned to protrude from the window 406; and when the switching lever 410 is fixed at the upper end of the slit 511, the detecting lever 503 is positioned away from the window 406.

In this manner, in the remaining amount detecting mechanism 500, the detecting unit may be moved by operating the switching lever 410 to a position activating detection. In the first embodiment, a moving mechanism includes the switching lever 410 and the slit 511.

(Detection of Remaining Amount)

Figure 10:
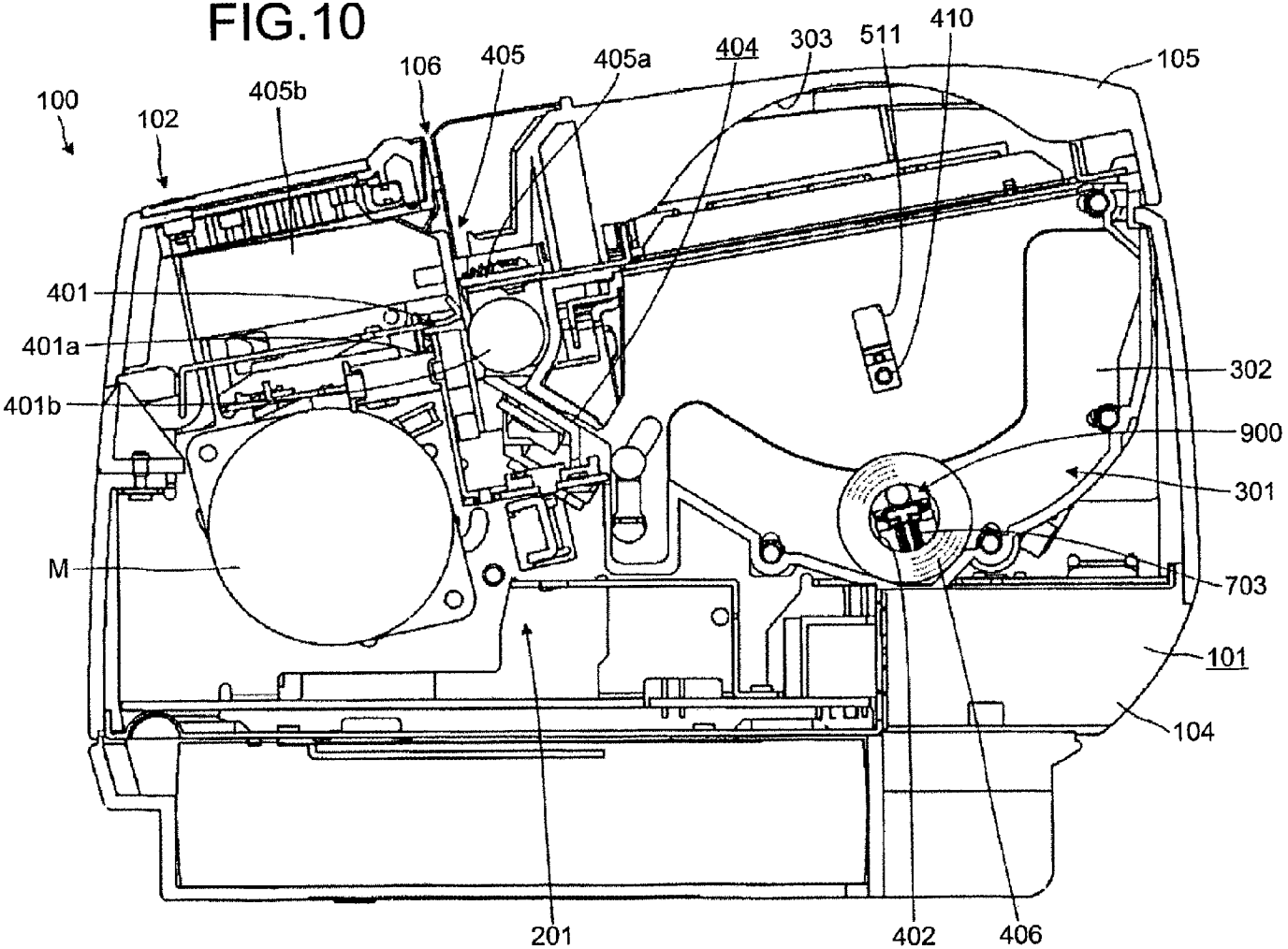
FIG. 10 is a first diagram for explaining a method of detecting by the remaining amount detecting mechanism.
Figure 11:
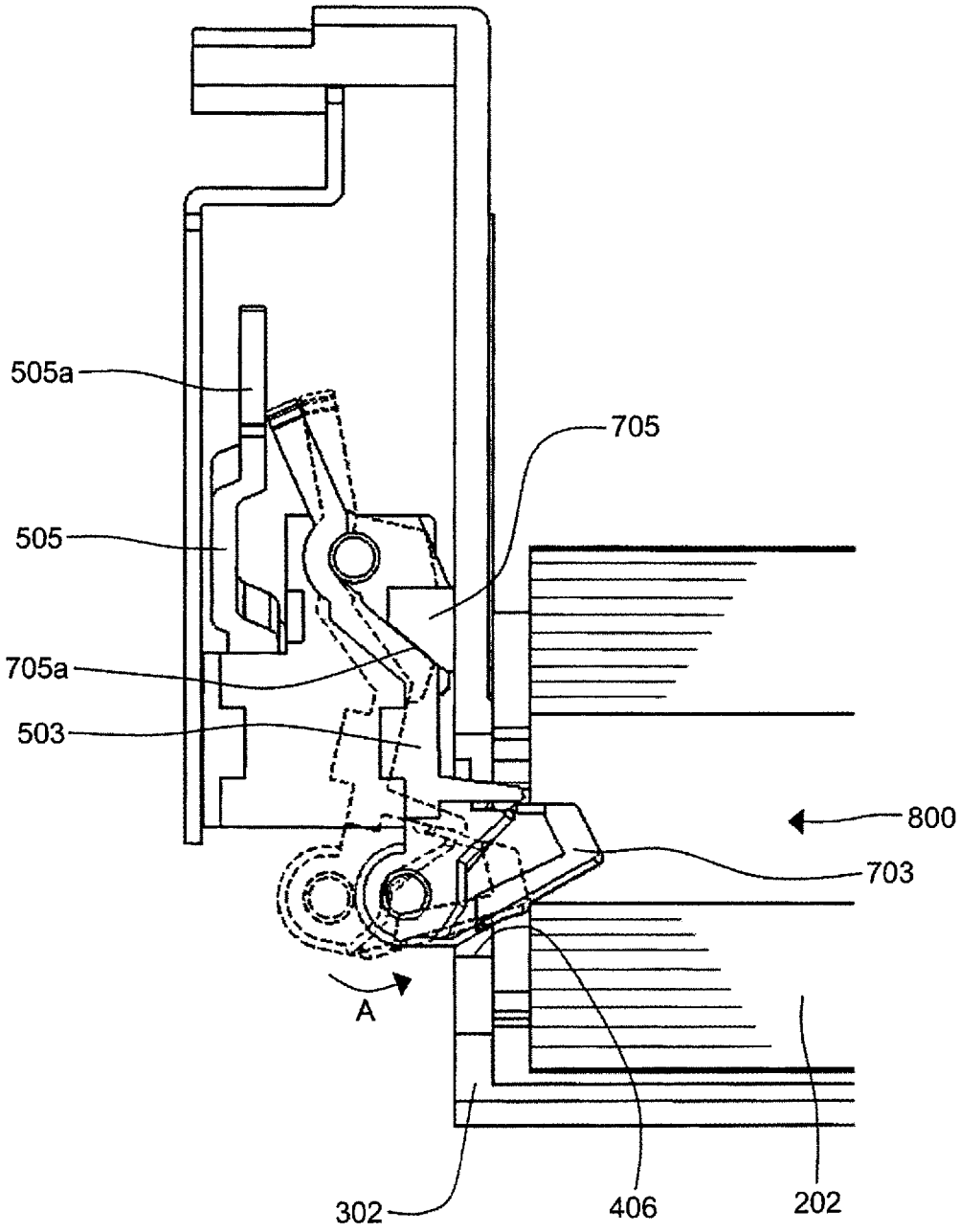
FIG. 11 is a second diagram for explaining the method of detecting by the remaining amount detecting mechanism.

A detection method used by the remaining amount detecting mechanism 500 will be described. FIGS. 10 and 11 are diagrams for explaining the detection method used by the remaining amount detecting mechanism 500. FIG. 10 depicts a cross section (along the A-A line in FIG. 1) of the printer apparatus 100 when the remaining amount of the recording medium 202 wound in a roll and accommodated in the recording medium accommodating unit 301 is the given amount or less. FIG. 11 depicts a cross section of the printer apparatus 100 along a plane that intersects the axial center of the recording medium 202 wound in a roll and accommodated in the recording medium accommodating unit 301, that is parallel to the axial center, and that is parallel to the swinging direction of the detecting lever 503.

In FIGS. 10 and 11, a space 900 formed by the core part in the center of the recording medium 202 wound in a roll moves with the consumption of the recording medium 202 held by the recording medium holding unit 402 such that the space 900 is received by the lower end of the curved aspect formed by the recording medium holding unit 402, by the weight of the recording medium 202. When the remaining amount of the recording medium 202 accommodated in the recording medium accommodating unit 301 is of a sufficient amount, the protrusion 703 abuts the side surface of the recording medium 202 wound in a roll. (Refer to dotted line in FIG. 11).

When the remaining amount of the recording medium 202 accommodated in the recording medium accommodating unit 301 becomes the given amount or less, the protrusion 703 faces the space 900 formed by the core part in the center of the recording medium 202. The detecting lever 503 is biased by the compression coil spring in the direction that the protrusion 703 moves to protrude toward the recording medium accommodating unit 301 and therefore, at the time when the protrusion 703 faces the space 900 formed by the core part, the detecting lever 503 swings such that the protrusion 703 enters the space 900, swinging in the direction indicated by arrow A in FIG. 11.

When the detecting lever 503 swings such that the protrusion 703 enters the space 900 formed by the core part, the end of the detecting lever 503 opposite of the protrusion 703 causes the end 505*a* of the interlocked detecting lever 505 that the end abuts to move toward the unit cover resisting the biasing force of the helical torsion coil spring. Thereby, the interlocked detecting lever 505 swings such that the other end 505*b* approaches the detection sensor 506.

The other end 505*b* of the interlocked detecting lever 505 approaches the detection sensor 506 and thereby, the output of the detection sensor 506 varies. More specifically, the other end 505*b* of the interlocked detecting lever 505 approaches the detection sensor 506 and thereby, the output of the detection sensor 506 varies, for example, from low to high. Based on the output value from the detection sensor 506 or variation in the output of the detection sensor 506, the remaining amount detecting mechanism 500 detects that the remaining amount of the recording medium 202 accommodated in the recording medium accommodating unit 301 is the given amount or less.

In this manner, the remaining amount detecting mechanism 500 of the first embodiment detects that the remaining amount of the recording medium 202 is the given amount or less by detecting the position of the core part based on an assumption that the number of turns of the recording medium 202 wound in a roll decreases as the recording medium 202 is consumed and the diameter of the recording medium 202 becomes smaller; whereby, the core part moves.

When the remaining amount detecting mechanism 500 detects that the remaining amount of the recording medium 202 accommodated in the recording medium accommodating unit 301 is the given amount or less, the printer apparatus 100 displays a warning on the liquid crystal displaying unit 110 and causes the LED lamp 109 to blink in red. The printer apparatus 100 also drives the sound output apparatus and outputs a predetermined notification sound. Thereby, the printer apparatus 100 may give notification that the remaining amount of the recording medium 202 is the given amount or less.

The printer 201 in the printer apparatus 100 of the first embodiment includes a control unit, not depicted, that drives and controls the components included in the printer 201. The control unit is provided in the casing 101 of the printer apparatus 100 and may be implemented by, for example, a micro computer that includes memories such as a ROM and a RAM, and a CPU.

The control unit controls the liquid crystal displaying unit 110, the LED lamp 109, and the sound output apparatus based on the result of the detection by the remaining amount detecting mechanism 500. More specifically, when the remaining amount of the recording medium 202 wound in a roll is detected to be the given amount or less based on the output from the detection sensor 506, the control unit drives and controls the liquid crystal displaying unit 110 to display the warning and also drives and controls the LED lamp 109 to blink in red. The control unit further controls the sound output apparatus to output spoken directions or a warning sound.

In this manner, the printer apparatus 100 may assuredly inform a user of the printer that the remaining amount of the recording medium has become the given amount or less, by displaying the warning on the liquid crystal displaying unit 110, causing the LED lamp 109 to blink in red, and outputting spoken directions or a warning sound from the sound output apparatus when the remaining amount of the recording medium 202 wound in a roll is the given amount or less. By giving notification using sound indicating that the remaining amount of the recording medium is the given amount or less, the near end of the recording medium 202 may assuredly be conveyed even when the user is away from the printer apparatus 100.

The detecting lever 503 used when the detecting unit is deactivated will be described. FIG. 12 is a diagram for explaining the detecting lever 503 and vicinity thereof when the detecting unit is deactivated. In FIG. 12, the protrusion 703 provided on the detecting lever 503 is positioned such that the protrusion 703 is retracted from the window 406 when the detecting unit is deactivated.

When the protrusion 703 is moved from the position where the protrusion 703 faces the window 406 to a position where the protrusion 703 is retracted from the window 406, the detecting lever 503 abuts the sloping aspect 705*a* of the retracting rib 705. The sloping aspect 705*a* is provided with the upward incline away from the window 406 such that the extent to which the protrusion 703 protrudes gradually increases with the incline and therefore, the protrusion 703, interlocked with the movement of the detecting lever 503, moves along the slope portion, approaching the unit covering member 501, to the position at which the detecting lever 503 retracts from the window 406.

Thereby, the detecting lever 503 swings, moving its end opposite to the protrusion 703 in a direction away from the end of the interlocked detecting lever 505. Thereby, the end opposite to the protrusion 703 of the detecting lever 503 and the end 505*a* of the interlocked detecting lever 505 are assuredly away from each other, and the interlocked detecting lever 505 is prevented from errantly swinging with the swinging of the detecting lever 503 in the detecting unit.

The printer apparatus 100 according to the first embodiment can deactivate the remaining amount detecting function of the remaining amount detecting mechanism 500. The remaining amount detecting function is deactivated in a state where the protrusion 703 is retracted from the window 406.

In the first embodiment, by positioning the switching lever 410 at the upper end of the slit 511, the detecting lever 503 can be positioned to cause the protrusion 703 to retract from the window 406.

In this manner, in the printer apparatus 100, i.e., the printer apparatus 100 of the first embodiment, the first detecting unit is easily and assuredly deactivated by mere operation of the switching lever 410. Thereby, the function of near end detection is not used and, for example, the remaining amount of the recording medium wound in a roll is determined by visually observing a marking provided at a final portion (a starting portion of the winding) of the recording medium, whereby the near end notification not needed by the user of the printer apparatus 100 is not executed.

A case where the detection sensor 506 is implemented by the transmission optoelectric sensor has been described in the first embodiment above. However, the detection sensor 506 is not limited to the transmission optoelectric sensor. More specifically, the detection sensor 506 may also be implemented by, for example, a micro-switch whose output varies corresponding to the presence or absence of contact by the interlocked detecting lever 505.

In the first embodiment above, notification of the near end of the recording medium 202 is given by the display of a warning on the liquid crystal displaying unit 110, blinking of the LED lamp 109, and sound output from the sound output apparatus. However, these notification units are not limited to those that are simultaneously operated. For example, any one of the notification units alone may give notification, or any two may give notification in combination.

As described above, the printer apparatus 100 according to the first embodiment is printer that supplies a recording medium 202 wound in a roll, from a recording medium accommodating unit 301 accommodating the recording medium 202 to a printing unit 401 and that prints on the recording medium 202. Formed in the recording medium accommodating unit 301 is a recording medium holding unit 402 that holds the recording medium 202 when the printer apparatus 100 is in an installed state. The printer apparatus 100 according to the first embodiment includes a detecting unit that detects that a core part in the center of the recording medium 202 has reached a predetermined position consequent to consumption of the recording medium 202 held by the recording medium holding unit 402; and a moving mechanism that moves the detecting unit to a position activating the detecting function of the detecting unit.

According to the printer apparatus 100 of the first embodiment, by moving the detecting unit, the detecting function of the detecting unit can be deactivated. Therefore, without complicated control, the detecting function of the detecting unit can be easily and assuredly deactivated.

Furthermore, since the detecting function can be deactivated according to the use of the printer apparatus 100 of the first embodiment, the versatility of the printer apparatus 100 is improved.

The printer apparatus 100 of the first embodiment characteristically includes the notification units that give notification that the remaining amount of the recording medium 202 is the given amount or less based on the detection result obtained by the detecting unit. More specifically, the printer apparatus 100 of the first embodiment gives notification that the remaining amount of the recording medium 202 is the given amount or less, by displaying a near end message on the liquid crystal displaying unit 110.

According to the printer apparatus 100 of the first embodiment, when the core part in the center of the recording medium 202 reaches a predetermined position consequent to the recording medium 202 being consumed, the notification unit may given notification that the remaining amount of the recording medium is the given amount or less. Thereby, the printer 201 can assuredly inform the user that the remaining amount of the recording medium 202 is the given amount or less.

The printer apparatus 100 of the first embodiment is characterized in that the detecting unit includes the protrusion 703 that abuts and biases the side surface of the recording medium 202 and entry of the protrusion 703 into the space of the core part is detected using the movement of the core part in the center of the recording medium 202.

According to the printer apparatus 100 of the first embodiment, by determining the mechanical action of the protrusion 703 to be detected, the reaching of a predetermined position may be detected of the core part in the center of the recording medium 202, the core part reaching the predetermined position consequent to the consumption of the recording medium 202 and the detection not being influenced by the movement of the recording medium 202 associated with the conveyance of the recording medium 202 during printing (such as an irregular movement of the recording medium 202 in the recording medium accommodating unit 301). Thereby, the remaining amount of the recording medium 202 is detected accurately to be the given amount or less.

The printer apparatus 100 of the first embodiment is characterized in that the detecting unit optically detects, using the movement of the core part, that the core part in the center of the recording medium 202 has reached the predetermined position. According to the printer apparatus 100 of the first embodiment, the physical size of the detecting unit may be a specific size regardless of the position of the core part in the center of the recording medium 202, which moves as the recording medium 202 is consumed. Thereby, downsizing of the mechanism related to the detection of the remaining amount of the recording medium 202 is facilitated.

(Second Embodiment)

A printer apparatus of a second embodiment according to the present invention will be described. In the second embodiment, components identical to those in the first embodiment will be given the same reference numerals used in the first embodiment and will not again be described. Compared to the above first embodiment, the printer apparatus of the second embodiment differs in that the printer apparatus of the second embodiment uses a reflection optoelectric sensor in the remaining amount detecting mechanism.

Figure 13:
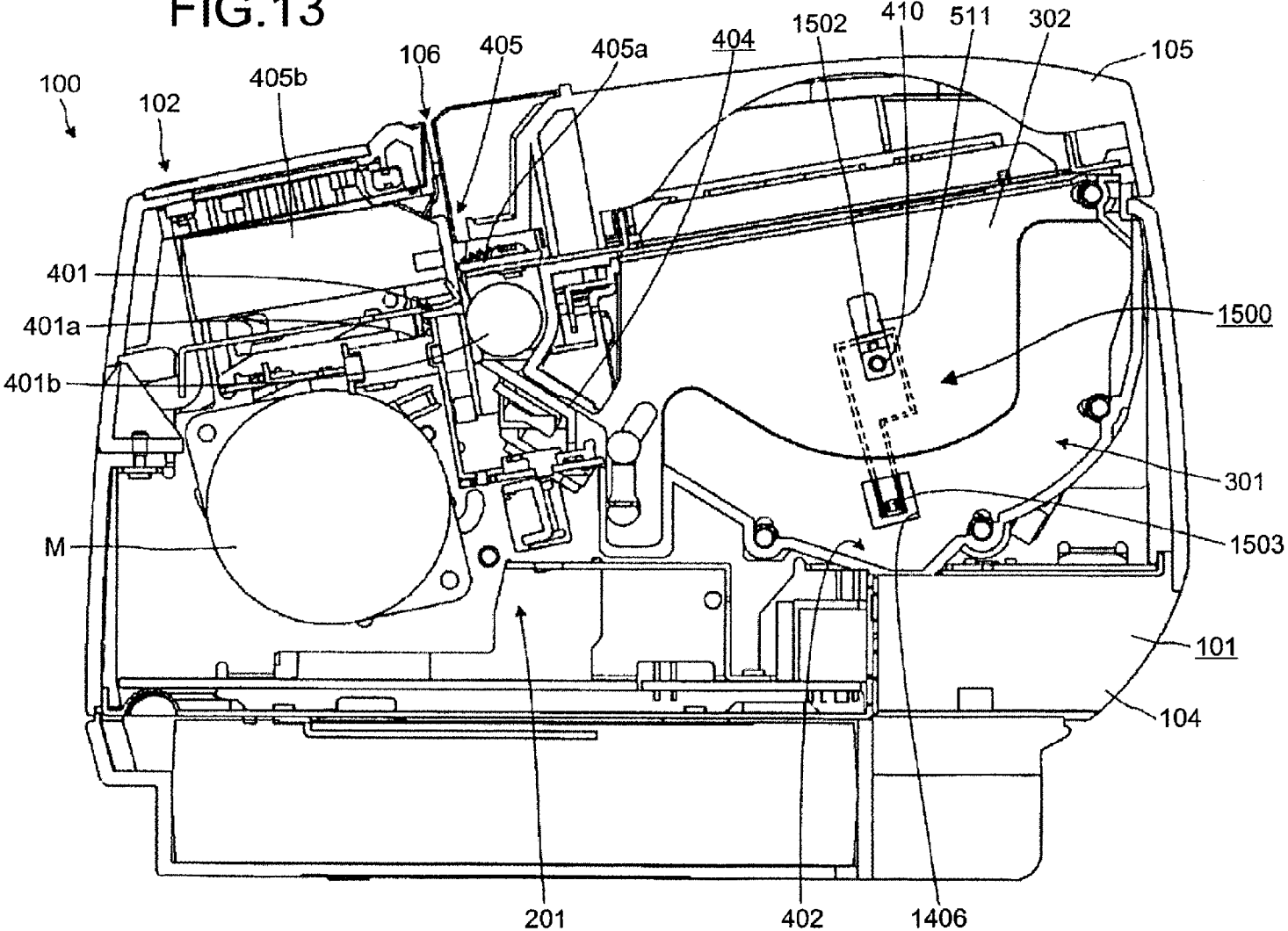
FIG. 13 is a diagram for explaining the printer apparatus according to a second embodiment of the present invention.

FIG. 13 is a diagram for explaining the printer apparatus according to a second embodiment of the present invention. FIG. 13 depicts a cross section (along the A-A line in FIG. 1) of the printer apparatus according to the second embodiment of the present invention. In FIG. 13, the printer apparatus 100 according to the second embodiment of the present invention includes a remaining amount detecting mechanism 1500.

The remaining amount detecting mechanism 1500 includes a detecting unit. In the remaining amount detecting mechanism 1500, the detecting unit includes a detection sensor 1503 that includes a reflection optoelectric sensor constituted of a light-emitting element and a light-receiving element mounted on a substrate.

Via the window provided in the side wall portion of the box-shaped member 302, the detecting unit of the remaining amount detecting mechanism detects the remaining amount of the recording medium 202 wound in a roll and held in the recording medium holding unit 402. FIG. 13 depicts a state in which the detecting unit is activated.

The second detection sensor 1503 is fixed to a unit frame member 1502. The switching lever 410 is integrated in the unit frame member 1502.

The unit frame member 1502 is provided in and can move within a space formed by the unit covering member 501 and the box-shaped member 302. The switching lever 410 is integrated with the unit frame member 502. The switching lever 410 is engaged with the slit 511 provided in the box-shaped member 302, and penetrates the slit 511 toward the recording medium accommodating unit 301.

The switching lever 410 is engaged with the slit 511, being movable along the slit 511. When the switching lever 410 is moved along the slit 511, the position of the unit frame member 1502 relative to that of the recording medium accommodating unit 301 changes. The slit 511 has a substantially linear shape and thereby, the unit frame member 1502 moves on a substantially linear-shaped trace.

In the slit 511, the engaging recesses are provided between the two ends of the slit 511. The switching lever 410 includes the engaging protrusions that can engage with the engaging recesses 701. The position of the switching lever 410 in the slit 511 can be fixed by engaging the engaging protrusion with the engaging recess 701.

With such a configuration, the position of the unit frame member 1502 relative to that of the recording medium accommodating unit 301 can be adjusted and the position of the unit frame member 1502 relative to that of the recording medium accommodating unit 301 can be fixed.

When the remaining amount of the recording medium 202 accommodated in the recording medium accommodating unit 301 is of a sufficient amount, the detection sensor 1503 faces the side surface of the recording medium 202 wound in a roll. A light beam emitted from the light-emitting element of the detection sensor 1503 reflects on a side surface of the recording medium 202 wound in a roll and is received by the light-receiving element of the detection sensor 1503. In this state, the detection sensor 1503 outputs an output value that is low.

When the remaining amount of the recording medium 202 accommodated in the recording medium accommodating unit 301 is the given amount or less, the detection sensor 1503 faces the space 900 formed by the core part in the center of the recording medium 202. In this state, the light beam emitted from the light-emitting element of the detection sensor 1503 is not received by the light-receiving element, and the detection sensor 1503 outputs an output value that is high.

The remaining amount detecting mechanism 1500 detects that the remaining amount of the recording medium 202 accommodated in the recording medium accommodating unit 301 is the given amount or less, based on the output value from the detection sensor 1503 or variation in the output of the detection sensor 1503.

In the remaining amount detecting mechanism 1500, the switching lever 410 is provided on the unit frame member 1502 and the detection sensor 1503 is provided on the unit frame member 1502 and therefore, the detection sensor 1503 moves when the unit frame member 1502 is moved by operating the switching lever 410.

To deactivate the detecting function of the detecting unit, the switching lever 410 is operated to retract the detection sensor 1503 from the window 406. When the detection sensor 1503 is positioned such that the detection sensor 1503 is retracted from the window 1406, a light beam emitted from the light-emitting element of the detection sensor 1503 reflects on a wall surface of a box-shaped member 1302 constituting a recording medium accommodating unit 1301 and is received by the light-receiving element of the detection sensor 1503. In this state, the detection sensor 1503 outputs an output value that is low.

In this manner, in the remaining amount detecting mechanism 1500, by operating the switching lever 410, the detecting unit is moved to a position activating detection by the detecting unit or to a position deactivating detection by the detecting unit.

As described above, the printer apparatus 100 of the second embodiment is characterized in that the detecting unit is implemented by the detection sensor 1503 that includes the reflection optoelectric sensor constituted of the light-emitting element and the light-receiving element mounted on the substrate, and the reaching of the core part to the predetermined position is optically detected.

According to the printer apparatus 100 of the second embodiment, the remaining amount of the recording medium 202 is detected using the detection sensor 1503 that includes the reflection optoelectric sensor, whereby downsizing of the mechanism concerning the detection of the remaining amount is facilitated. Thereby, downsizing of the printer 201 and the printer apparatus 100 including the printer 201 is facilitated.

Having a simple mechanism employing an adjusting mechanism for adjusting the attachment height of a conventional near-end detecting unit, the printer apparatus according to the present invention enables easy and assured deactivation of the detecting function of the detecting unit, thereby effecting a low cost method of increasing the versatility of the printer apparatus.

Further, the printer apparatus according to the present invention is characterized in that in the recording medium accommodating unit, a guide unit is formed between a position that detects that the core part in the center portion of the recording medium has reached the predetermined position and a position that deactivates a detecting function of the detecting unit. Further, engaging units that engage with the guide unit are formed on the detecting unit.

According to the present invention, the detecting function of the detecting unit can be easily and assuredly deactivated since the detecting unit is moved between the position that detects that the core part in the center portion of the recording medium has reached the predetermined position and the position that deactivates a detecting function of the detecting unit by the guide unit formed in the recording medium accommodating unit and the engaging units.

The printer apparatus according to the present invention further includes a notification unit that gives notification that a remaining amount of the recording medium is a given amount or less, based on a detection result obtained by the detecting unit.

According to the present invention, when the core part in the center portion of the recording medium reaches the predetermined position consequent to the recording medium being consumed, the notification unit may given notification that the remaining amount of the recording medium is the given amount or less. Thereby, the printer can assuredly inform the user of the printer that the remaining amount of the recording medium is the given amount or less.

Further, in the printer apparatus according to the present invention, the detecting unit includes a protrusion that biases and abuts a side surface of the recording medium, and detects entry of the protrusion into a space of the core part in the center portion of the recording medium by a movement of the core part.

According to the present invention, by determining the mechanical action of the protrusion to be detected, it can be detected that the core part in the center portion of the recording medium has reached the predetermined position as the recording medium is consumed, without the detection being affected by left/right movement of the recording medium with the conveyance of the recording medium during printing. Thereby, it can be detected accurately that the remaining amount of the recording medium is the given amount or less.

Further, in the printer apparatus according to the present invention, the detecting unit optically detects that the core part in the center portion of the recording medium has reached the predetermined position by a movement of the core part.

According to the present invention, the physical size of the detecting unit may be a specific size regardless of the position of the core part in the center portion of the recording medium, varying as the recording medium is consumed. Thereby, downsizing of the mechanism concerning the detection of the remaining amount of the recording medium is facilitated.

(Effect)

According to the printer apparatus of the present invention, by a simple configuration, the detecting function of the detecting unit can be easily and assuredly deactivated, effecting improved versatility of the printer apparatus.

(Industrial Application)

As described above, a printer according to the present invention is useful for a printer that holds a recording medium wound in a roll and that prints on the recording medium, and is especially suitable for a printer that may take plural installation orientations.

What is claimed is:

1. A printer apparatus supplying a recording medium that is in a rolled state, from a recording medium accommodating unit accommodating the recording medium to a printing unit, to execute printing, the printer apparatus comprising:

a recording medium holding unit that holds the recording medium and is formed in the recording medium accommodating unit;

a detecting unit that detects that a core part in a center portion of the recording medium has reached a predetermined position accompanying consumption of the recording medium held in the recording medium holding unit; and a user switch lever that selectively moves the detecting unit between a position that activates the detecting unit and a position that deactivates the detecting unit; wherein the detecting unit comprises a protrusion that biases and abuts a side surface of the recording medium, and detects entry of the protrusion into a space of the core part in the center portion of the recording medium by a movement of the core part; and the printer apparatus further comprising a retracting rib configured to prevent the protrusion from swinging when the detecting unit is in the position that deactivates the detecting function.

2. The printer apparatus according to claim 1 further comprising:

a guide unit formed in the recording medium accommodating unit, between a position that activates a detecting function of the detecting unit to detect that the core part in the center portion of the recording medium has reached the predetermined position and a position that deactivates the detecting function; and engaging units that engage with the guide unit and are formed on the detecting unit.

3. The printer apparatus according to claim 2 further comprising a notification unit that gives notification that a remaining amount of the recording medium is a predetermined amount or less, based on a detection result obtained by the detecting unit.

4. The printer apparatus according to claim 3, wherein the detecting unit comprises a protrusion that biases and abuts a side surface of the recording medium, and detects entry of the protrusion into a space of the core part in the center portion of the recording medium by a movement of the core part.

5. The printer apparatus according to claim 3, wherein the detecting unit optically detects that the core part in the center portion of the recording medium has reached the predetermined position by a movement of the core part.

6. The printer apparatus according to claim 2, wherein the detecting unit comprises a protrusion that biases and abuts a side surface of the recording medium, and detects entry of the protrusion into a space of the core part in the center portion of the recording medium by a movement of the core part.

7. The printer apparatus according to claim 2, wherein the detecting unit optically detects that the core part in the center portion of the recording medium has reached the predetermined position by a movement of the core part.

8. The printer apparatus according to claim 1 further comprising a notification unit that gives notification that a remaining amount of the recording medium is a predetermined amount or less, based on a detection result obtained by the detecting unit.

9. The printer apparatus according to claim 8, wherein the detecting unit comprises a protrusion that biases and abuts a side surface of the recording medium, and detects entry of the protrusion into a space of the core part in the center portion of the recording medium by a movement of the core part.

10. The printer apparatus according to claim 8, wherein the detecting unit optically detects that the core part in the center portion of the recording medium has reached the predetermined position by a movement of the core part.

11. The printer apparatus according to claim 1, wherein the detecting unit optically detects that the core part in the center portion of the recording medium has reached the predetermined position by a movement of the core part.

12. The printer apparatus according to claim 1, wherein a slit is disposed in the recording medium accommodating unit, engaging recesses are disposed between both ends in the slit, the switch lever engages with the slit in a state of being moveable along the slit, and the position of the switch lever in the slit can be fixed with the engaging recesses.

* * * * *